US007213723B2

(12) United States Patent
Schwarzli

(10) Patent No.: US 7,213,723 B2
(45) Date of Patent: May 8, 2007

(54) BULK VENDING MACHINE

(75) Inventor: Josef W. Schwarzli, Stouffville (CA)

(73) Assignee: Beaver Machine Corporation, Newmarket, Ontario (CA)

( * ) Notice: Subject to any disclaimer, the term of this patent is extended or adjusted under 35 U.S.C. 154(b) by 283 days.

(21) Appl. No.: 10/528,649

(22) PCT Filed: Sep. 26, 2003

(86) PCT No.: PCT/CA03/01482

§ 371 (c)(1),
(2), (4) Date: Mar. 21, 2005

(87) PCT Pub. No.: WO2004/029890

PCT Pub. Date: Apr. 8, 2004

(65) Prior Publication Data

US 2006/0000846 A1 Jan. 5, 2006

(30) Foreign Application Priority Data

Sep. 26, 2002 (CA) ..... 2405361

(51) Int. Cl.
*G07F 11/00* (2006.01)

(52) U.S. Cl. ..... 221/254; 221/24; 221/210; 221/217; 221/165; 221/166

(58) Field of Classification Search ..... 221/24, 221/210, 217, 165, 166, 254, 167
See application file for complete search history.

(56) References Cited

U.S. PATENT DOCUMENTS 1,885,797 A 11/1932 Branica
2,001,110 A 5/1935 Rabkin

FOREIGN PATENT DOCUMENTS

DE 136 040 C 11/1902
DE 1 574 202 A 4/1971

*Primary Examiner*—Gene O. Crawford
*Assistant Examiner*—Timothy Waggoner
(74) *Attorney, Agent, or Firm*—Dimock Stratton LLP; Mark B. Eisen

(57) ABSTRACT

A bulk vending machine provides a dispensing conduit having a revolving mouth that floats on top of a heap of articles in the product bin. The mouth is movable between a horizontal orientation, in which the mouth can scoop articles off of the surface of the heap, and a vertical orientation in which a throat of the dispensing conduit opens to allow an article which has been scooped into the mouth to fall through the dispensing chute. Revolution of the dispensing conduit by turning the handle causes the mouth to revolve around the heap of articles, scooping up one or more articles in its path.

20 Claims, 12 Drawing Sheets

FIG.1.
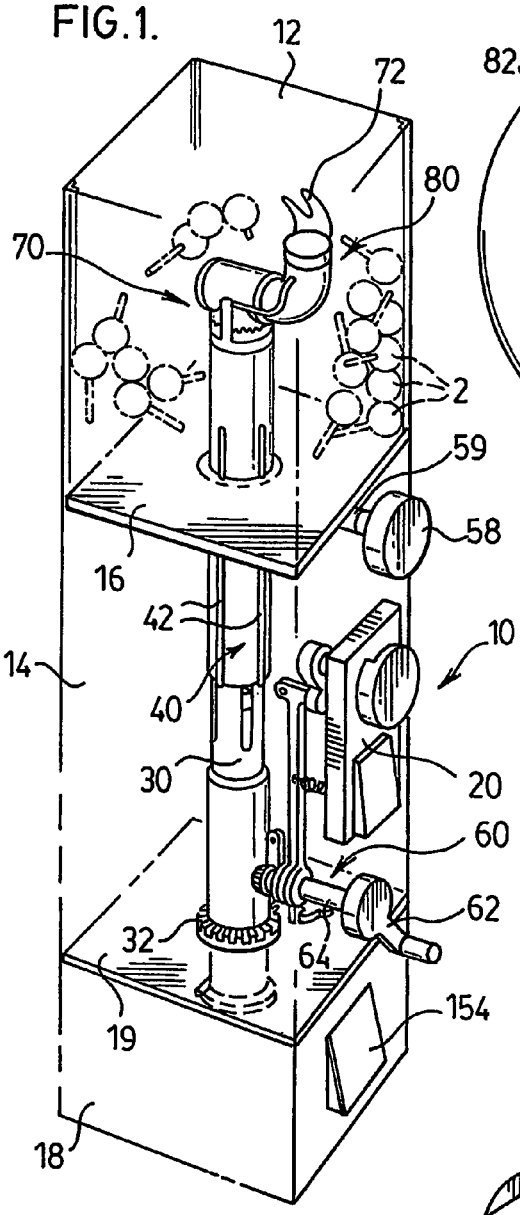
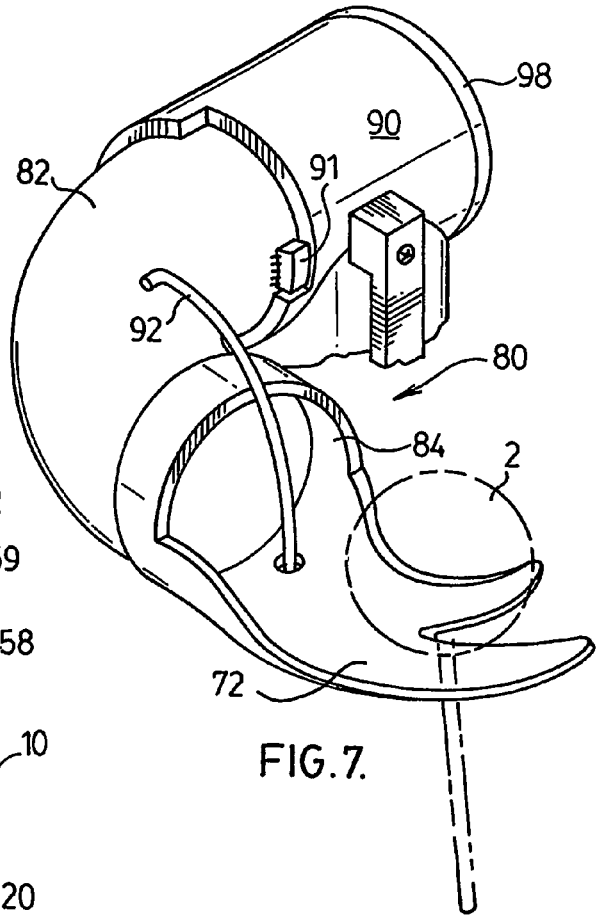
FIG.7.
FIG.8.
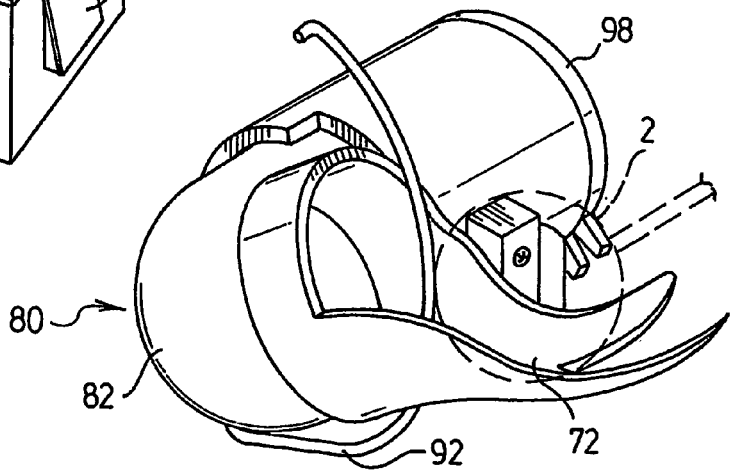

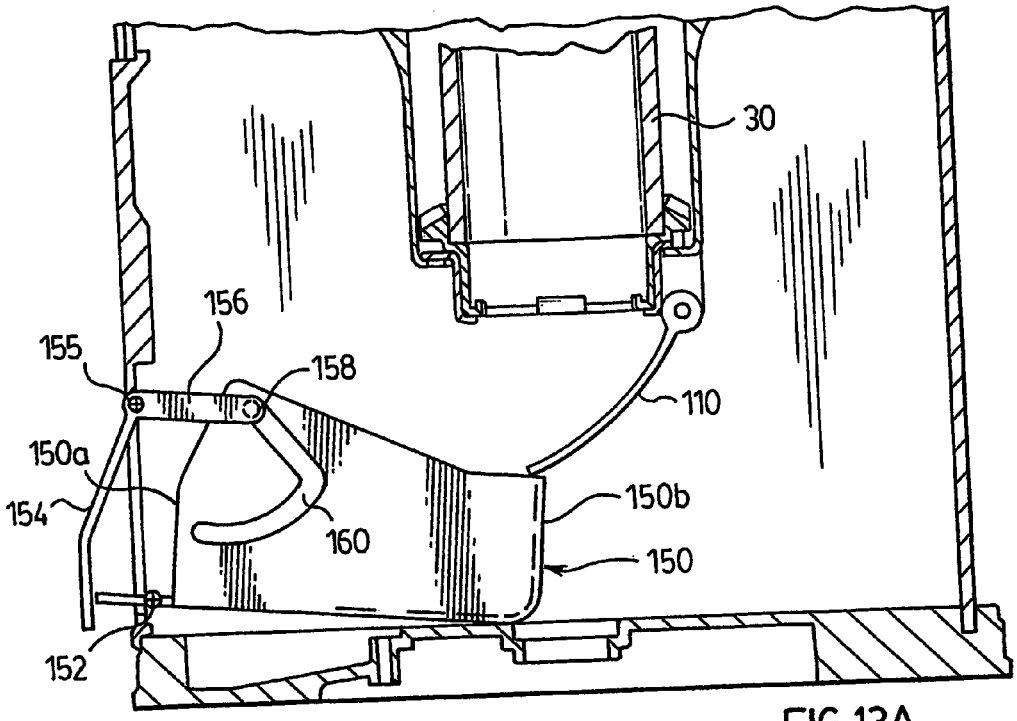
FIG.13A.
FIG.13B.
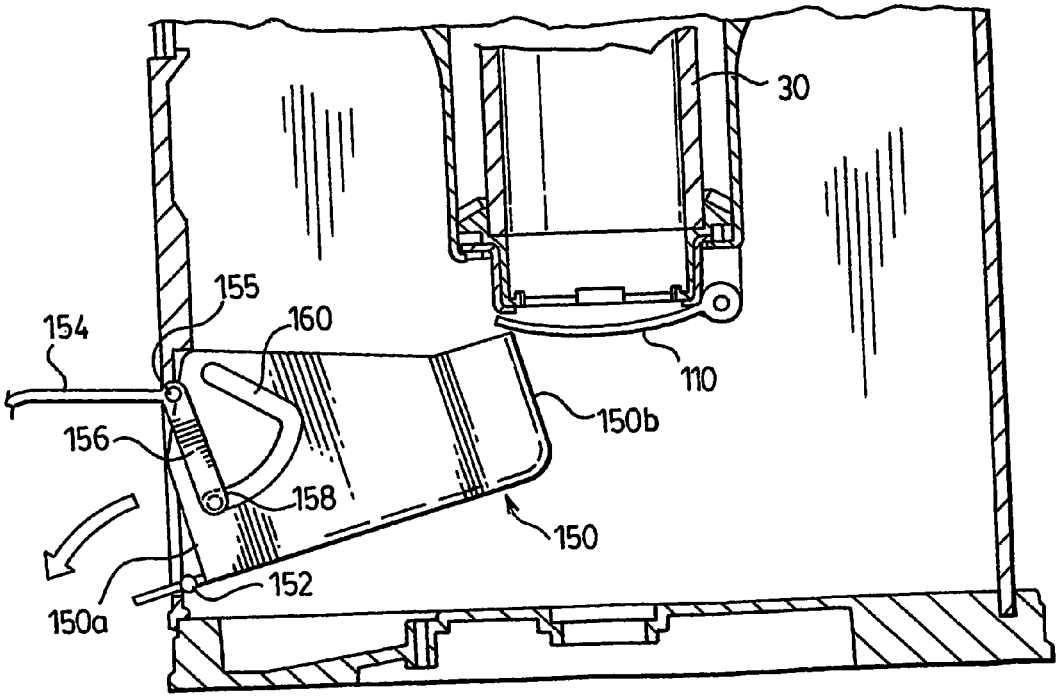

BULK VENDING MACHINE

FIELD OF THE INVENTION

This invention relates to vending machines. In particular, this invention relates to a bulk vending machine for vending articles of any shape.

BACKGROUND OF THE INVENTION

Bulk venders, colloquially known as "gum ball machines", are widely used for dispensing confectioneries and other small articles of merchandise. A typical bulk vender has a hopper assembly comprising a transparent merchandise storage bin, seated over a dispensing wheel that revolves in a hopper. A plurality of product compartments are recessed into the dispensing wheel. A patron deposits the required token or coin into the coin mechanism and turns the handle, which rotates the dispensing wheel to move one of the product compartments over a dispensing chute, and thus conveys a preset amount of merchandise to the dispensing chute. The hopper assembly is located over a body which is mounted on a base, defining a secure compartment containing a cash box into which the coin mechanism ejects the deposited token or coin. Bulk venders of this type are well known to those skilled in the art.

Bulk vending machines tend to dispense merchandise in fairly accurate metered amounts as long as the merchandise is smooth-walled and has a relatively regular shape (e.g. is symmetrical about two or three orthogonal planes). Articles having these characteristics tend to fill the product compartments in the dispensing wheel fairly uniformly, because they drop easily into the product compartments and are self-packing so the overall product density remains substantially uniform throughout the product bin and in each product compartment. Bulk venders are therefore well suited for the unsupervised dispensing of articles such as gumballs and other hard, round or oval confectionary, because the user can virtually be guaranteed to receive the same preset amount of product with each revolution of the coin mechanism.

However, conventional bulk venders are relatively poorly suited for dispensing rough-surfaced articles and articles which have an irregular shape, such as toys and lollypops. These types of articles tend not to provide a uniform product density throughout the product bin and do not fall neatly into the product compartments, with the result that a different volume of merchandise (and sometimes no merchandise at all) may be dispensed with each rotation of the coin mechanism. This is unacceptable, because it introduces an element of risk into the purchase of product from a bulk vender, and consumers will not purchase merchandise from a bulk vender if there is any perceived risk that they will not receive the product that they are paying for.

Conventional bulk venders are also unsuitable for vending soft articles, because of the way a conventional bulk vender is configured. In order to ensure that the dispensing chute is not in direct communication with the product bin (which would result in product free-flowing through a product compartment to the user), the portion of the dispensing wheel situated over the dispensing chute is covered by a shroud. Rotation of the dispensing wheel pushes the next successive product compartment underneath the shroud, where it comes into communication with the dispensing chute and empties the product through the dispensing chute, as is well known. Soft articles (and some irregularly shaped articles) can become wedged between the trailing edge of the product compartment and the shroud, jamming the vender. This is also unacceptable, because the operators of such venders rely upon the continuous operation of the vender for revenue generation. Each time the vender jams, not only does the operator have to incur the cost of service personnel to repair the jam, but potential revenues during the interval between jamming and repair are lost.

As such, there are limited types and shapes of articles which can be dispensed from a conventional bulk vender without special packaging. In order to vend irregularly-shaped articles or soft articles, one or more articles must be placed into a symmetrical hard-shelled capsule. This significantly increases the cost of the product. In some cases the cost of capsule can exceed the cost of the product, making the sale by bulk vender impractical. Accordingly, bulk venders are not generally used to dispense such merchandise.

It would accordingly be advantageous to provide a bulk vender which is capable of dispensing irregularly-shaped and soft articles without requiring any special packaging. It would further be advantageous to provide such a vender which is entertaining to view in operation, to attract users and thus increase revenues to the vending machine operator.

SUMMARY OF THE INVENTION

The present invention provides a bulk vending machine which is capable of dispensing any type of article, including soft articles and irregularly-shaped articles. The vending machine of the invention is suitable for vending virtually any kind of article, irrespective of the shape or texture of the articles' exterior surfaces.

The invention accomplishes this by providing a dispensing conduit having a revolving mouth that floats on the top of a heap of articles in the product bin. The mouth is movable between a horizontal orientation, in which the mouth can scoop articles off of the surface of the heap, and a vertical orientation in which a throat of the dispensing conduit opens to allow an article which has been captured by the mouth to fall through the dispensing chute and be dispensed to the purchaser.

In the preferred embodiment rotation of the coin mechanism actuates a clutch, which engages a user-accessible handle to the dispensing conduit. Revolution of the dispensing conduit by turning the handle causes the mouth to revolve around the heap of articles, scooping up one or more articles in its path. The mouth is preferably provided with an adapter configured to accommodate the specific shape of the article being vended. Also, in the preferred embodiment a second user-accessible handle permits rotation of the mouth between horizontal and vertical orientations and the mouth has two operative positions: when horizontal the mouth is in a capturing position capable of capturing an article; once the article has been captured the user can rotate the mouth to a vertical position, which allows the captured article to fall through the dispensing conduit into a dispensing chute, which is accessible to the user.

In the preferred embodiment the head is supported by a cable which is weighted by counterweights, reducing the effective weight and allowing the head to remain on top of the heap of articles to facilitate the capture of an article by the mouth.

The present invention thus provides a vending machine, comprising a product bin for storing articles, disposed above a secure compartment, a dispensing chute in communication with a neck, the dispensing chute being accessible to a user and the neck being movable substantially vertically within the product bin, a mouth movable between a capturing position and a dispensing position, to be respectively in communication with articles the product bin and with the neck, the mouth being capable of revolving about an axis of the neck, and an actuator for actuating a mechanism to revolve the mouth about the axis of the neck, whereby when the mouth is in the capturing position, revolution of the mouth captures an article from the top of the articles, and when the mouth is rotated to the dispensing position the article is dispensed through the neck and the dispensing conduit.

The present invention further provides a method of vending an article in a bulk vender comprising a product bin for storing articles disposed above a secure compartment, a mouth in communication with a neck in communication with a dispensing chute accessible to a user, the mouth being movable substantially vertically within the product bin and rotatable between a capturing position in which the mouth is communication with articles the product bin and a dispensing position in which the mouth is in communication with the neck but not the articles in the product bin, comprising the steps of: a moving the mouth to the capturing position; b. enabling a revolving mechanism and revolving the mouth about the product bin to capture at least one article; c. moving the mouth to the dispensing position, such that the captured article is dispensed through the neck into the dispensing chute; and d. preventing further revolution of the mouth after the captured article has been dispensed until the revolving mechanism is enabled.

BRIEF DESCRIPTION OF THE DRAWINGS

In drawings which illustrate by way of example only a preferred embodiment of the invention, FIG. 1 is a partially cutaway perspective view of a bulk vender embodying the invention with the top and top securing bracket removed for purposes of illustration, FIG. 7 is a perspective view of the mouth in a capturing position, FIG. 8 is a perspective view of the mouth in an intermediate position, FIG. 13A is a side elevation showing the dispensing chute in the rest position, and FIG. 13B is a side elevation showing the dispensing chute in the dispensing position.

DETAILED DESCRIPTION OF THE INVENTION

Figure 2A:
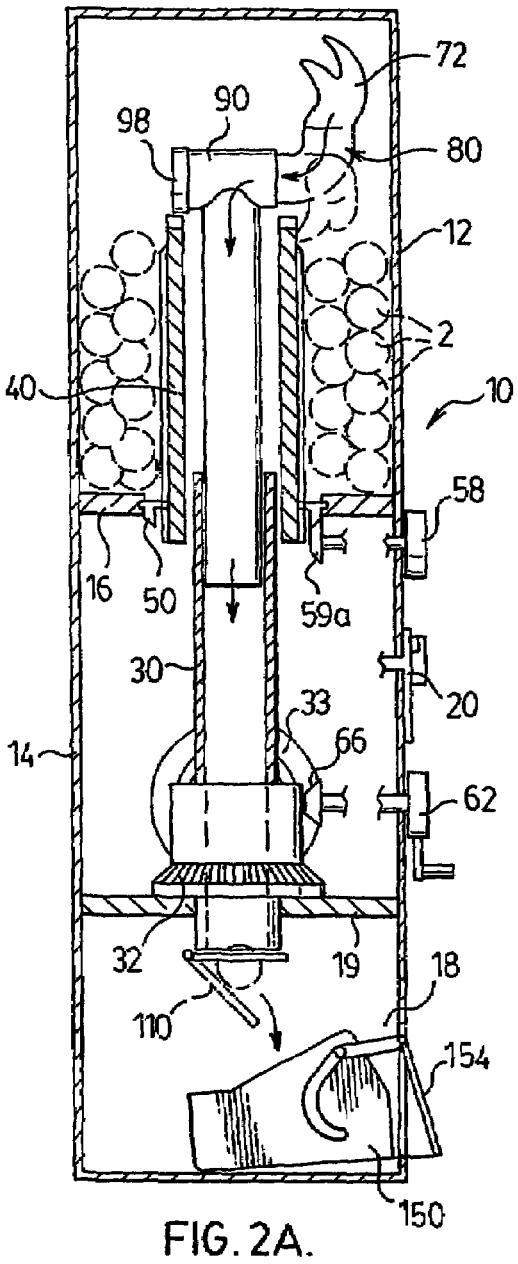
FIG. 2A is a cross-sectional side elevation of the bulk vender of FIG. 1 showing the product bin substantially full.

A bulk vending machine 10 according to the present invention conventionally comprises a transparent product bin 12 seated over a secure compartment 14. The product 12 is separated from the secure compartment 14 by a floor 16. The secure compartment 14 contains the coin mechanism 20, the cash box (not shown) into which coins 1 are deposited by the coin mechanism 20, and the mechanisms which connect the user-operated knobs to the operative portions of the vender 10. The secure compartment 14 may be separated by a divider 19 from a base compartment 18 containing the dispensing chute 150, to prevent a user from gaining access to the secure compartment 14; however, in the preferred embodiment the dispensing chute 150 itself provides a mechanism for preventing access to the inside of the base compartment 18, as is described in detail below.

Articles 2 in the product bin 12 are dispensed to the user by being captured by a head 70 comprising a mouth 80, the head 70 being movable substantially vertically within the product bin 12 so that the mouth 80 remains at the top of the heap of articles 2 in the product bin 12. According to a preferred embodiment of the invention, a tubular dispensing conduit 30 projects through the floor 16. The dispensing conduit 30 is retained in a fixed position over the dispensing chute 150 and extends through the secure compartment 14 to approximately the level of the floor 16. The dispensing conduit 30 is rotationally fixed adjacent to its lower end to a dispensing conduit gear 32. The dispensing conduit 30 is revolved by a dispensing conduit drive gear mechanism 60, illustrated in detail in FIG. 5, which is engaged to the dispensing conduit gear train 31 when the coin mechanism 20 is rotated, in the manner described in detail below. The gear mechanism 60 is rotated by a user-accessible dispensing conduit drive handle 62 via shaft 64 disposed through the wall of the secure compartment 14. Thus, when the gear mechanism 60 is engaged to the dispensing conduit gear train 31, as described in detail below, rotation of the dispensing conduit drive handle 62 translates into revolution of the dispensing conduit 30.

Figure 3A:
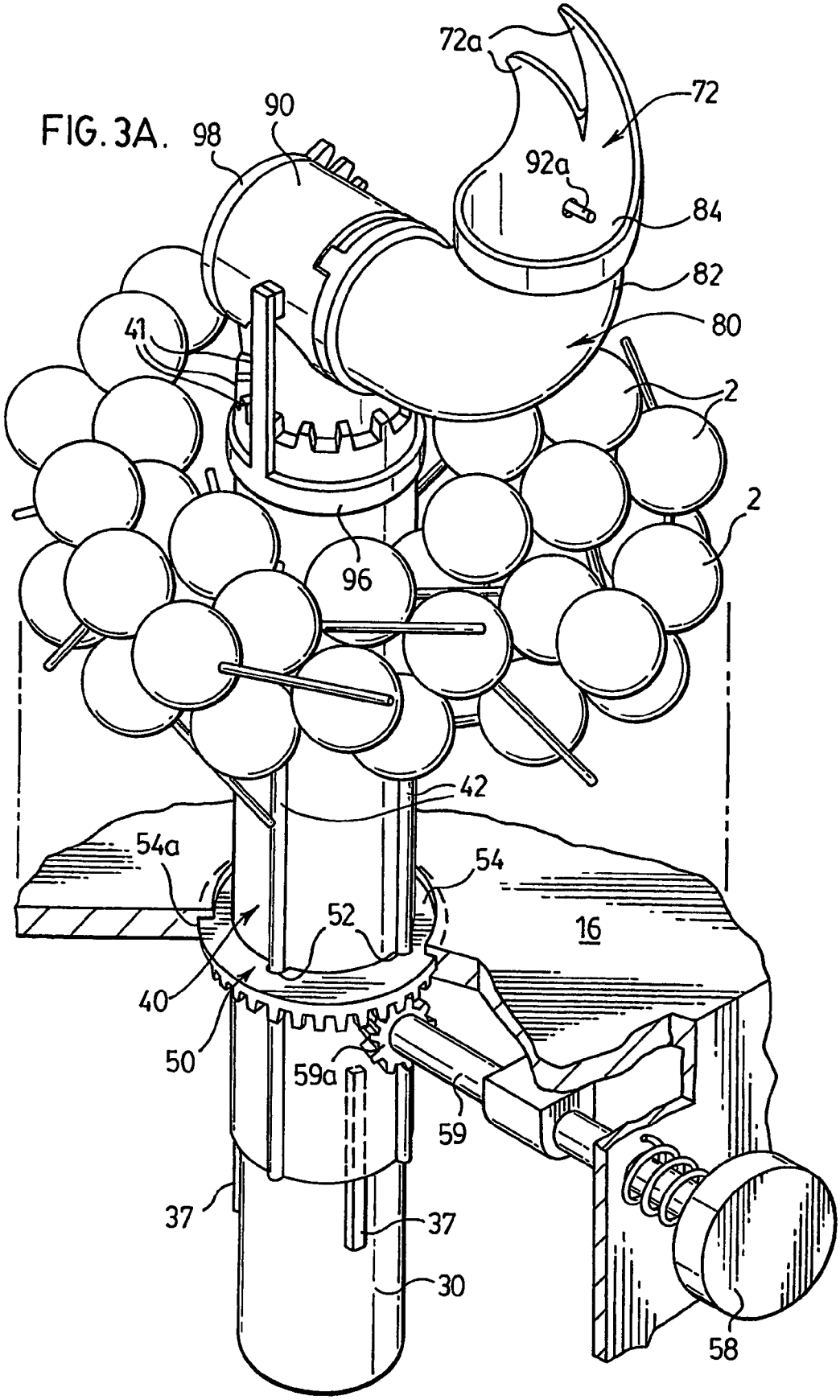
FIG. 3A is a partially cutaway perspective view of the mouth rotation mechanism.

Movably mounted over the dispensing conduit 30, preferably in telescoping relation, is a tubular neck 40. The neck 40 is slidably mounted through a neck rotation gear 50, and rotationally fixed relative to the gear 50 by ribs 42 which slide through complementary axial recesses 52 formed along the hub of the gear 50, best seen in FIG. 3A. The gear 50 is rotationally mounted to the floor 16, for example trapped in a slot 54*a* milled into the peripheral edge of opening 54 and circumscribing the gear 50. Thus, rotation of the neck rotation gear 50 revolves the neck 40, while at the same time the neck 40 can move freely axially through the neck rotation gear 50 and telescopically over the dispensing conduit 30.

Figure 6:
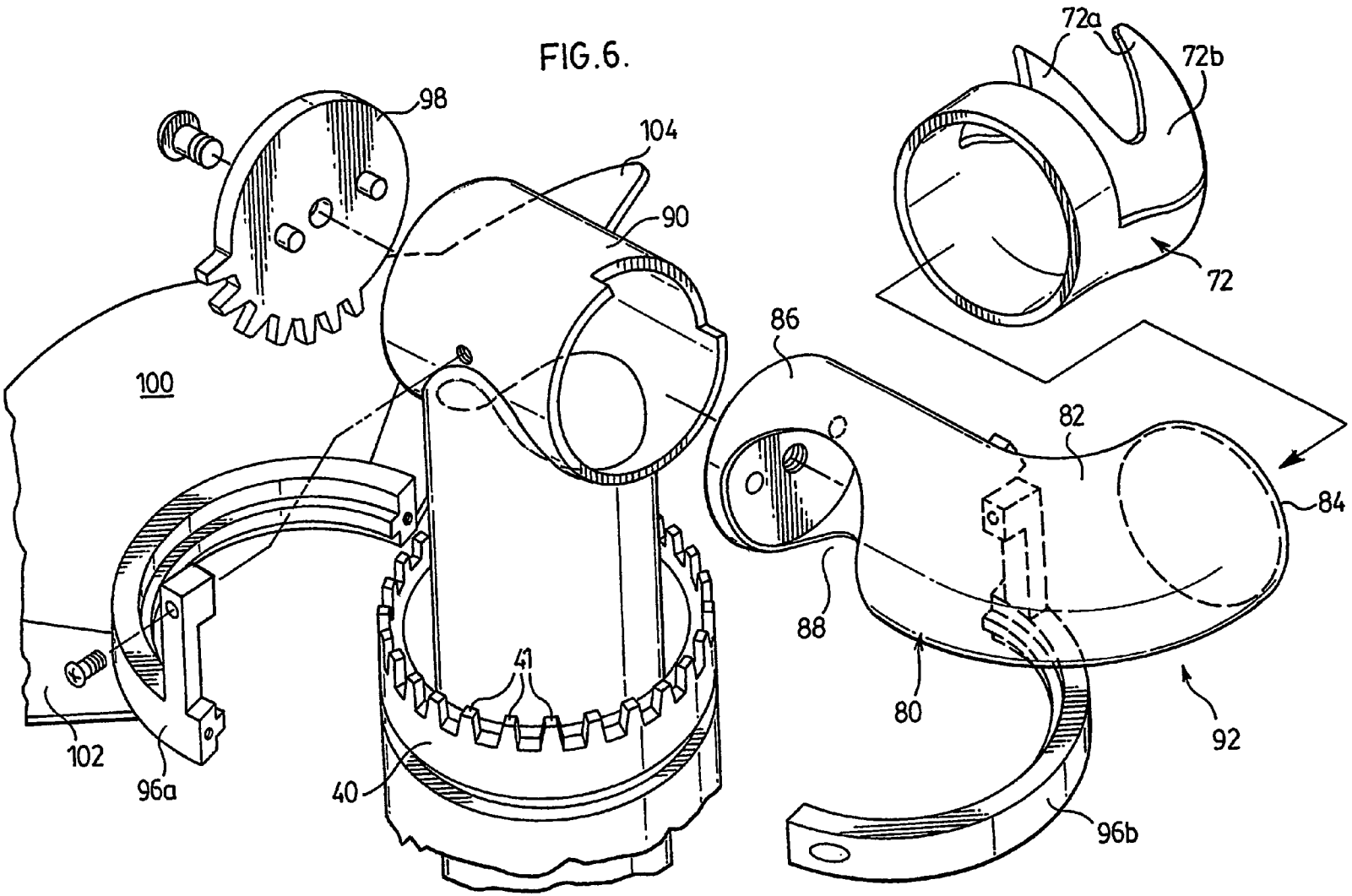
FIG. 6 is an exploded perspective view of the mouth rotation mechanism.

Mounted on top of the neck 40 is the head 70, comprising a mouth 80 rotationally mounted to a throat 90. The throat 90 is mounted to the neck 40, for example by an annular collar 96 which may comprise collar portions 96*a*, 96*b* as shown in FIG. 6. The mouth 80 preferably comprises a tubular elbow 82 having an exposed end 84 for receiving an article 2 from the product bin 12 and a concealed end 86, best seen in FIG. 6, contained inside the throat 90 and rotationally mounted to the throat 90.

Figure 3B:
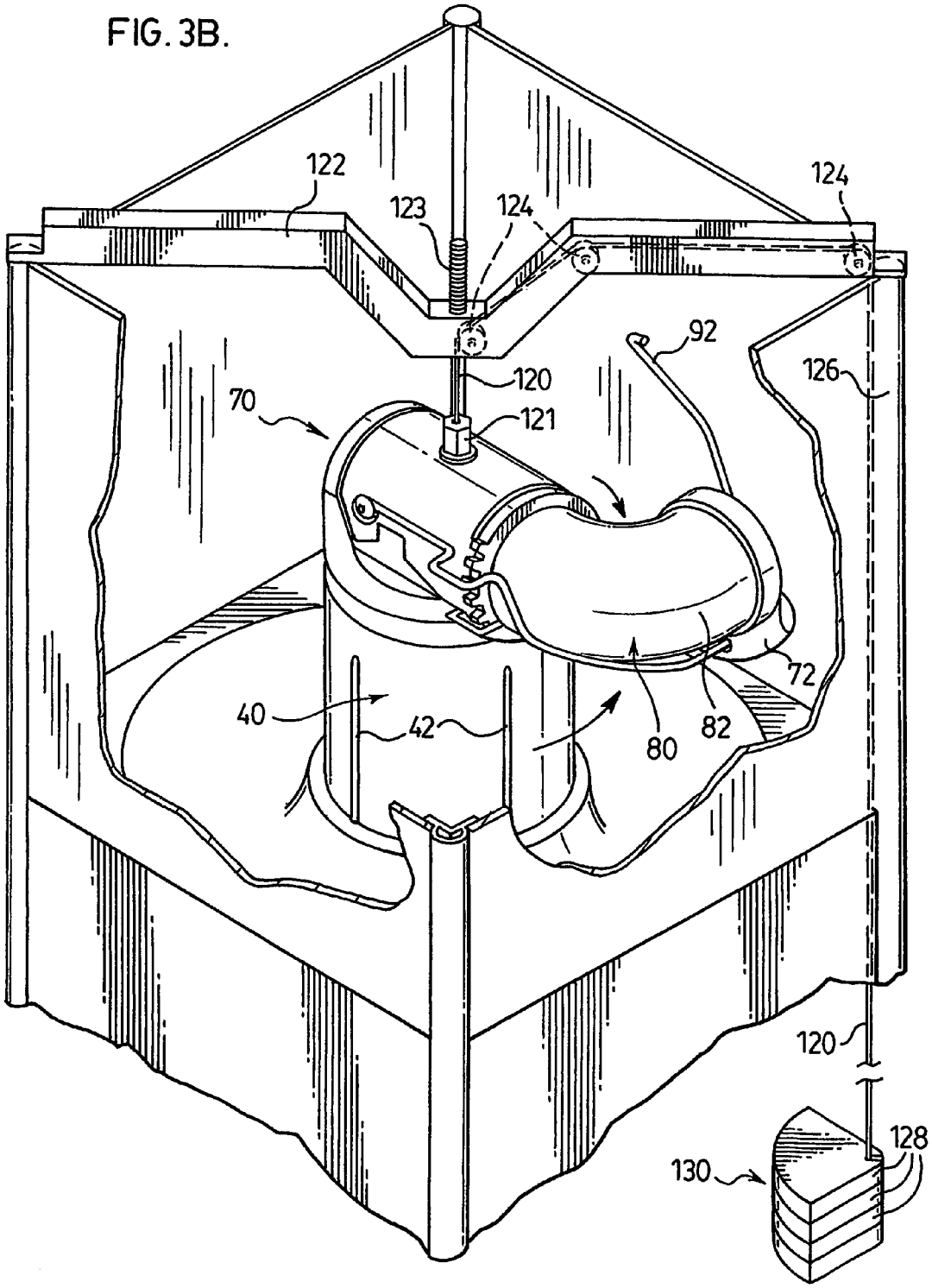
FIG. 3B is a partially cutaway perspective view of the vender showing the head supported in the product bin.
Figure 3C:
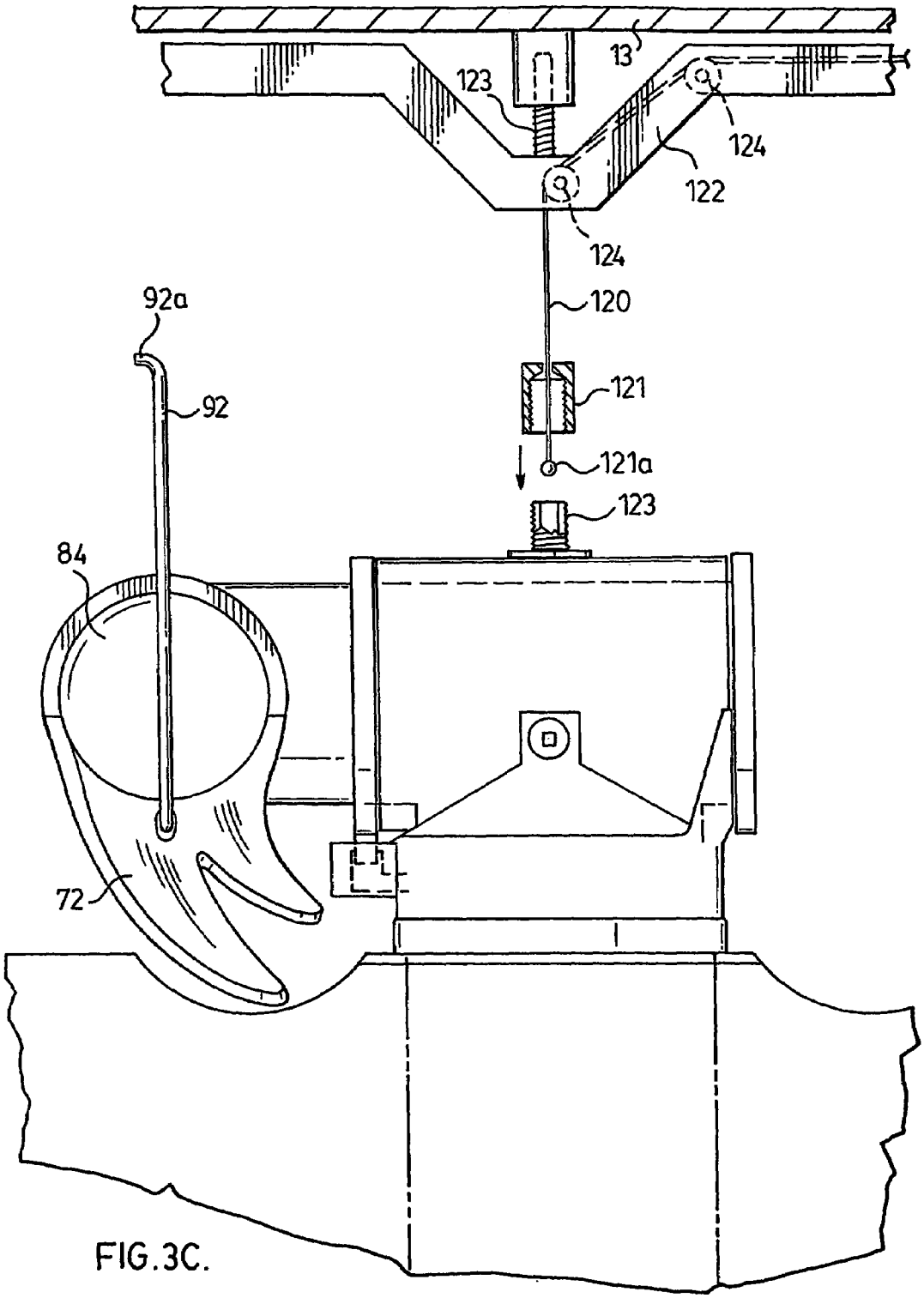
FIG. 3C is a side elevation showing the manner of supported the head.
Figure 4:
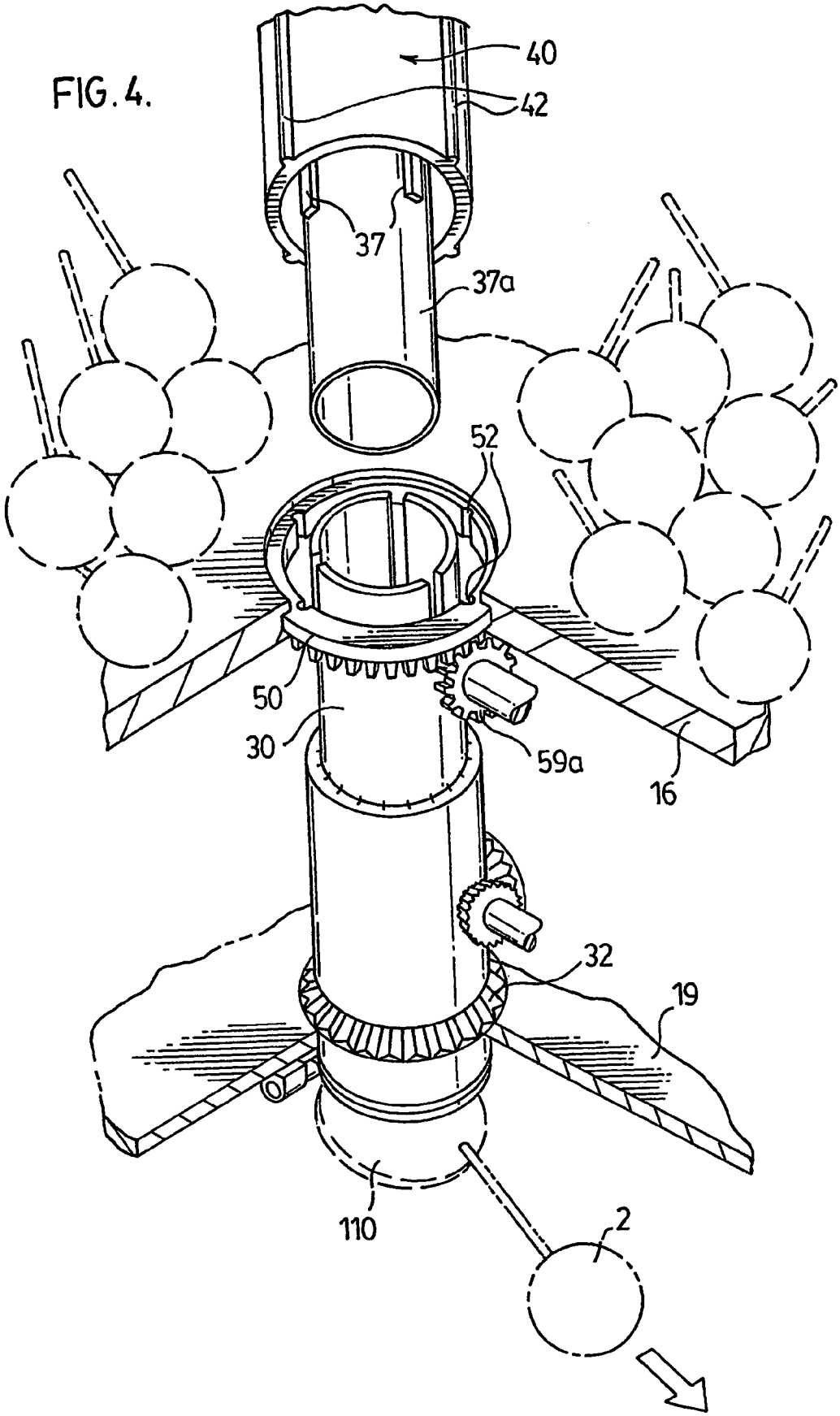
FIG. 4 is a partially cutaway perspective view of the dispensing conduit revolution mechanism.

In order to promote the extraction of an article 2 off of the top surface of the heap of articles 2, which both facilitates the capture of an article 2 and reduces abrasive decomposition of other articles 2 in the storage bin 12, means for maintaining the head 70 on top of the articles 2 is provided. In the preferred embodiment the head 70 is supported in the product bin 12 by a cable 120, best illustrated in FIGS. 3B and 3C, which suspends the head 70 to reduce the effective weight of the head/neck assembly to just a few ounces. The head/neck assembly is thus supported by the cable 120, but not fully suspended, so the head/neck assembly will descend under the influence of gravity as the heap of articles 2 in the product bin 12 diminishes, but the effective weight of the head/neck assembly is too small to apply any significant force to the heap of articles 2, which might otherwise damage the articles 2 in the product bin 12 as the neck 80 is rotated.

Preferably the cable 120 is removable to allow for servicing and maintenance, for example being affixed to the mouth 80 by nut 121 trapping enlargement 121*a* and engaged to threaded post 123. In the embodiment shown the cable 120 is fed through pulleys 124 mounted within the bracket 122 that secures the top 13 (shown in FIG. 3C), through one of the extrusions 126 forming the frame for the product bin 12 (and optionally trapped therein by appropriately configured plugs, not shown), and into the secure compartment 14. Within the secure compartment 14 the cable 120 is affixed to weights 128, which are preferably individually removable cumulatively serve as an adjustable counterweight 130. In this fashion the effective weight of the head/neck assembly can be set as required for the particular articles being vended, so that the mouth 80 always remains "floating" on top of the heap of articles 2 and does not become submerged within the heap of articles 2. It will be appreciated that the cable supporting system may not be necessary with every type of articles, and some types of articles will by their nature support the head 70 without the need for additional support.

Figure 11:
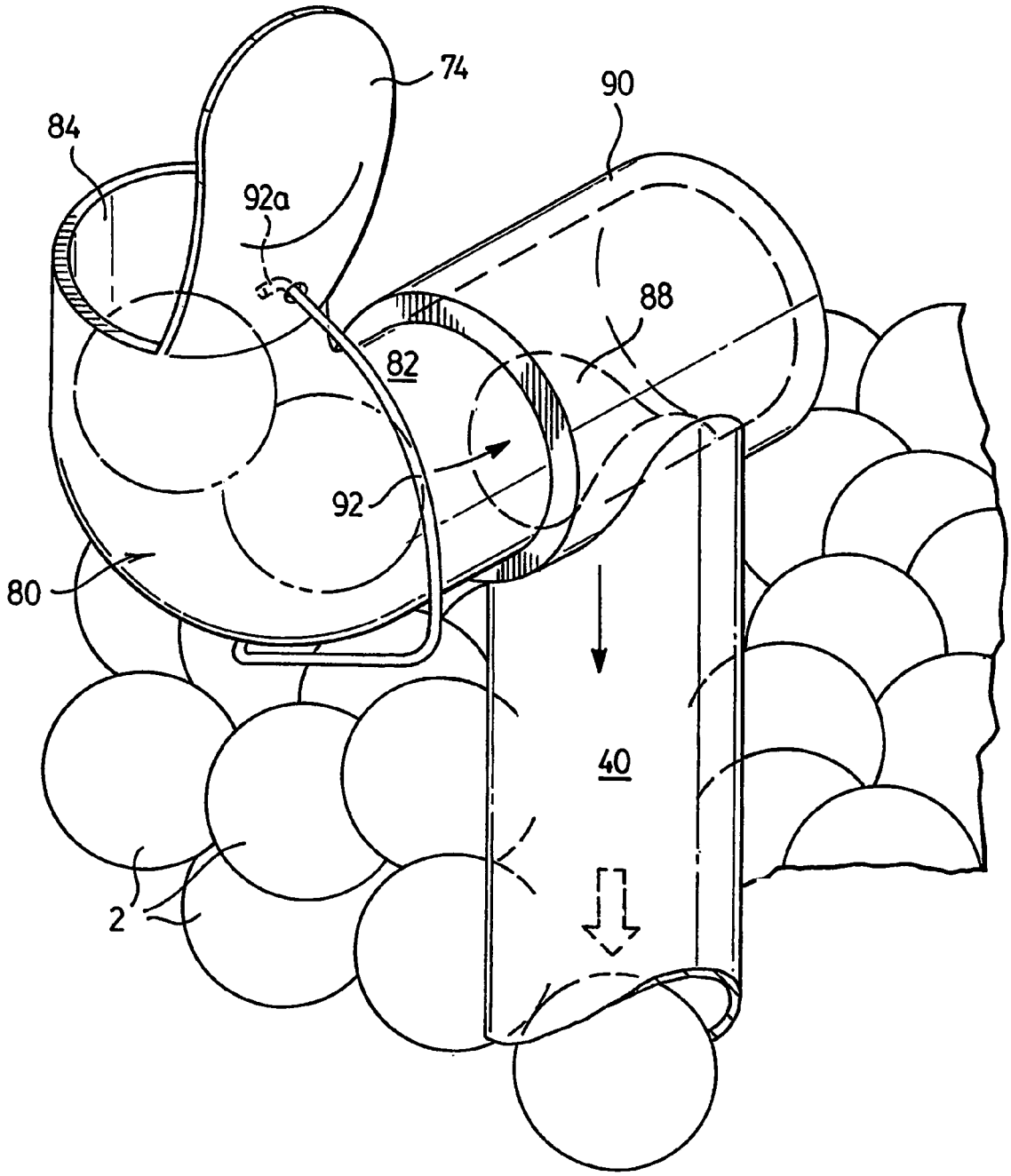
FIG. 11 is a perspective view of the mouth equipped with an adaptor suitable for capturing and dispensing a gumball.
Figure 12:
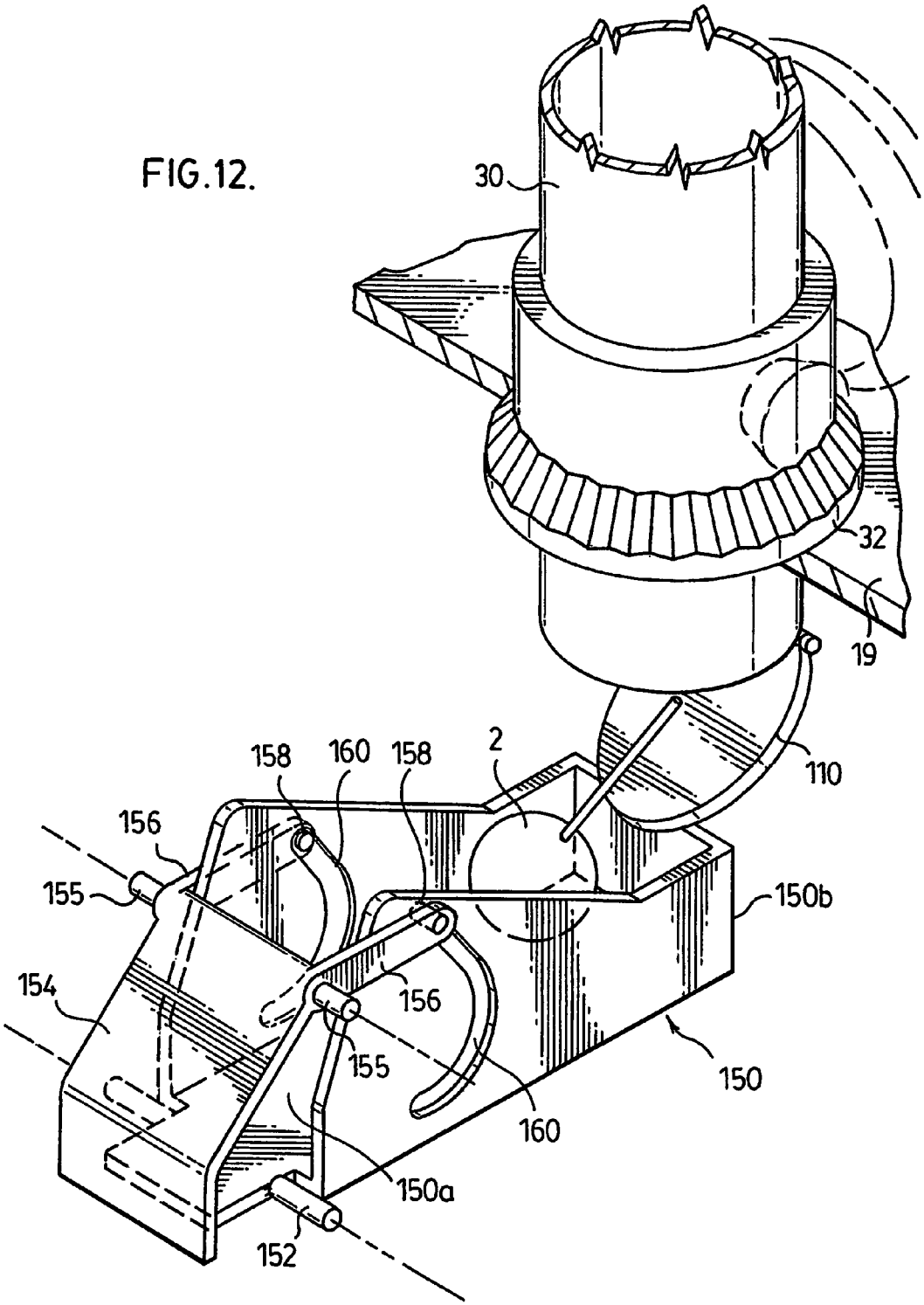
FIG. 12 is a perspective view of the dispensing chute.

The exposed end 84 of the mouth 80 is provided with an adapter 72 configured to capture a single article 2 from the heap of articles 2 in the product bin 12. In the embodiment shown in FIG. 3A the articles 2 are lollipops, which are irregularly-shaped by the provision of a ball of confectionary at one end of a stick. Accordingly, the adapter 72 is configured with claws 72*a* projecting from a scoop 72*b* to most readily capture a lollipop. It will be appreciated that different types of articles 2 may require differently configured adapters to maximize opportunities for capturing the article 2 as the mouth 80 is revolved around the product bin 12, for example the scoop-shaped adaptor 74 illustrated in FIG. 11 which is particularly suitable for capturing a gumball. The configuration of the adapter is a matter of selection, determined by the type and shape of article 2 being vended and the number of articles 2 desired to be dispensed with each cycle of the coin mechanism 20.

Figure 10:
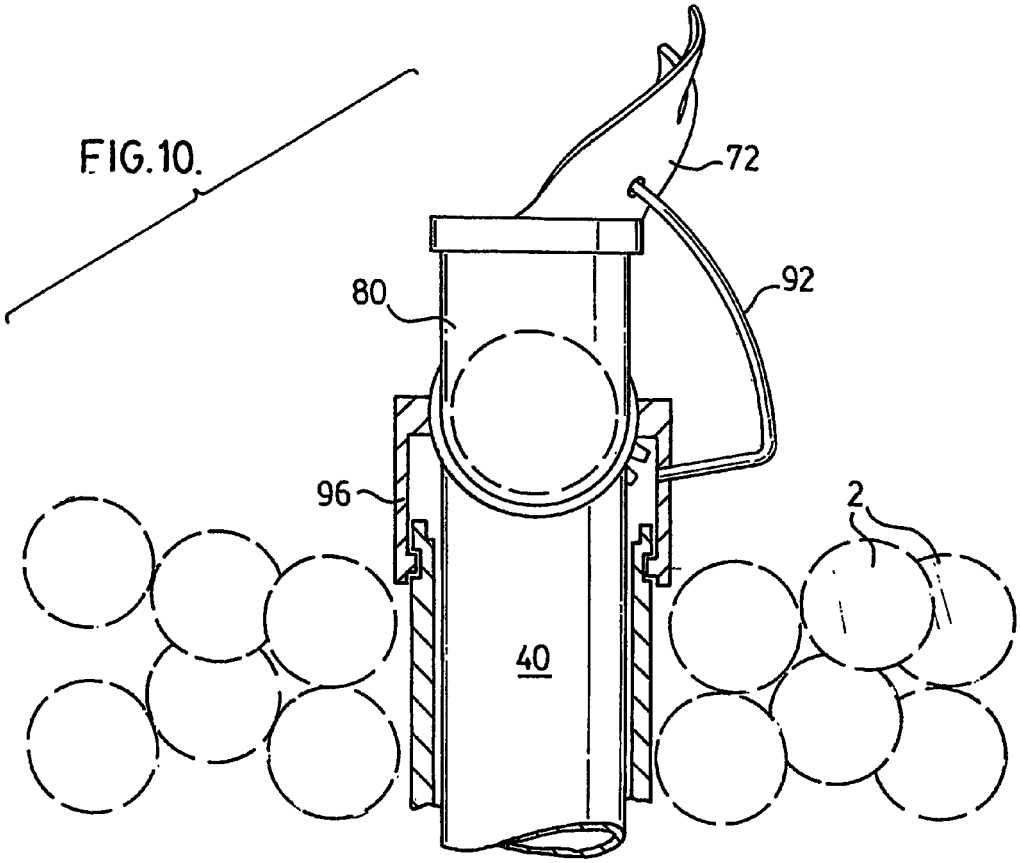
FIG. 10 is a perspective view of the head of FIG. 9 with the mouth in a dispensing position.
Figure 9:
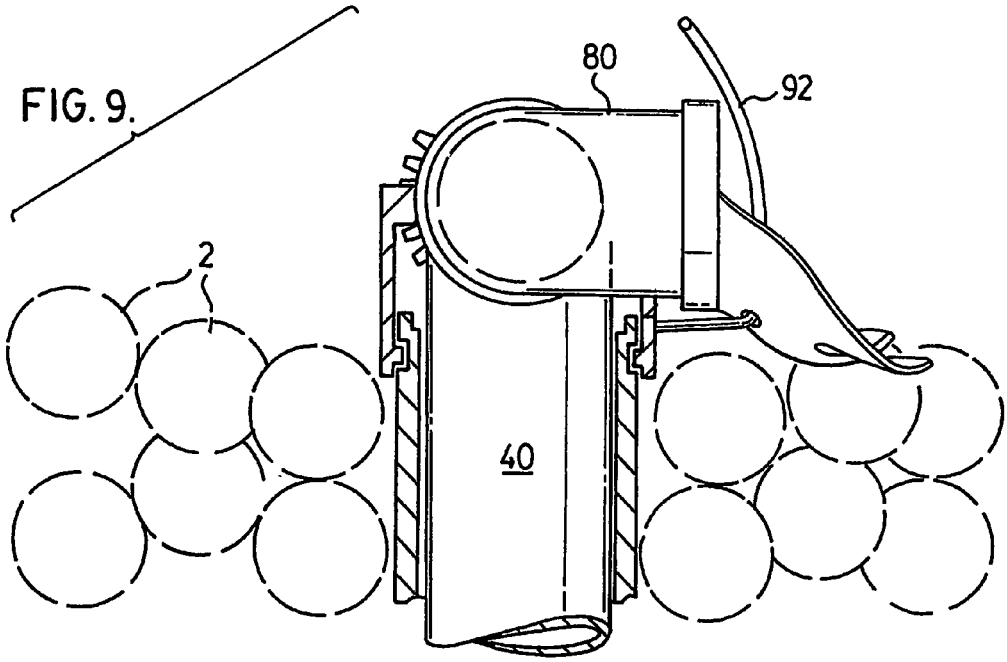
FIG. 9 is a perspective view of the head equipped with an adaptor suitable for capturing and dispensing a lollypop, with the mouth in a capturing position.

The mouth 80 is rotatable between a capturing position, in which the exposed end 84 of the mouth 80 is oriented generally axially horizontally as shown in FIG. 9, and a dispensing position in which the exposed end 84 of the mouth 80 is oriented generally axially vertically as shown in FIG. 10. Preferably an opening 88 in the side wall of the elbow 82 near the concealed end 86 of the mouth 80 comes into alignment with the neck 40 only when the mouth 80 is in the dispensing position shown in FIG. 10, so that when the mouth 80 is lowered from the dispensing position, the exposed end 84 of the mouth 80 is positioned to capture an article 2, but the opening 88 is out of alignment with the neck 40, closing off the neck 40 and effectively blocking the dispensing conduit 30. This prevents a user from obtaining multiple articles 2 by continuous revolution of the dispensing conduit 30 with the mouth 80 in the capturing position.

To further prevent the unintentional vending of multiple articles 2 during a single dispensing cycle of the coin mechanism 20, the exposed end 84 of the mouth 80 is blocked (or partially blocked) by a finger 92 when the mouth 80 is in the capturing (horizontal) position. The finger 92 may be fixed to the collar 96 on which the throat 90 is mounted, and configured and oriented such that throughout the path of rotation of the mouth 80 from the capturing position shown in FIG. 9 until just before the dispensing position shown in FIG. 10, the finger 92 intrudes through a hole in the adapter 72 and blocks the exposed end 84 of the mouth 80. The finger 92 will thus prevent a captured article 2 from entering the exposed end 84 of the mouth 80, as shown in FIG. 8, until the mouth 80 has reached the dispensing position shown in FIG. 3B. Once the mouth 80 has reached the dispensing position, the finger 92 has receded from the exposed end 84 of the mouth 80 (see FIG. 3A) and allows the captured article 2 to fall into the mouth 80 to be dispensed to the user. Preferably the finger 92 has a bent or hooked end 92*a*, preventing dislodgement of the finger 92 from the adapter 72.

The mouth 80 is rotated between the capturing and dispensing positions by a set of teeth 41 formed in the top rim of the neck 40, engaging a mouth rotation gear 98 affixed to the concealed end 86 of the mouth 80. Since the mouth 80 is only required to rotate about 90°, it is only necessary to provide teeth along the circumference of part of the mouth rotation gear 98. It is also only necessary to provide teeth 41 along part of the rim of the neck 80, however to avoid requiring service personnel to align the neck 40 when loading the product bin 12 it may be preferable to provide teeth 41 around the entire rim of the neck 80 as shown in FIG. 6. A stop 91 (shown in FIG. 7) should be provided to prevent the mouth 80 from over-rotating in either direction.

The neck rotation knob 58 is permanently coupled to the neck rotation gear 50 via shaft 51 and bevel gear 59*a*. Thus, even without depositing a coin into the coin mechanism 20, the mouth 80 can be rotated between the capturing and dispensing positions. However, without revolving the dispensing conduit 30 to move the mouth 80 about the product bin 12, it is not likely that the adapter 72 could capture an article 2. Accordingly, while in an alternative embodiment (not shown) it is also possible to use the clutch mechanism to block or disengage the neck rotation knob 58 at the same time as the dispensing conduit drive knob 62, this would ordinarily be unnecessary.

Figure 5:
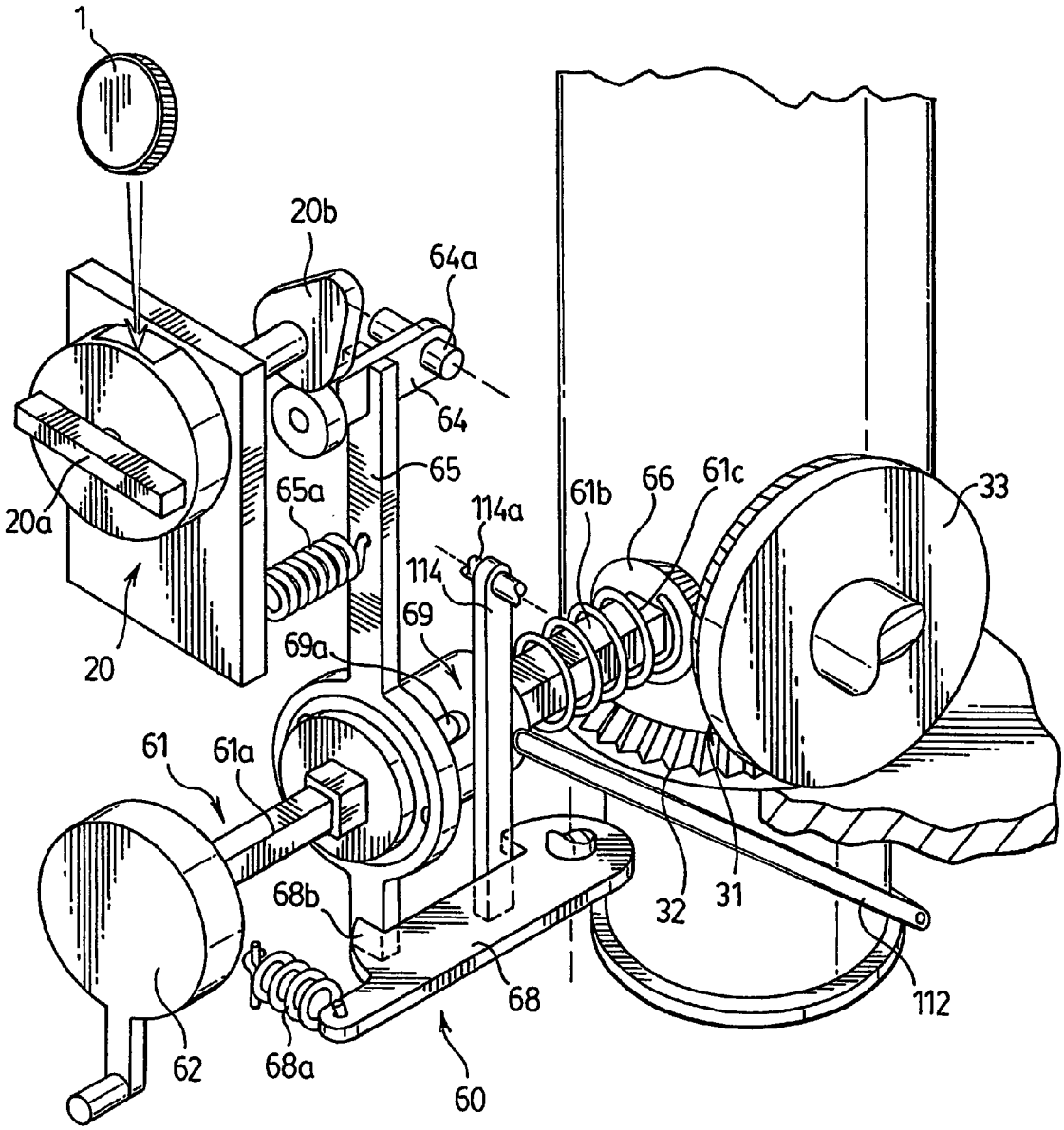
FIG. 5 is a perspective view of the clutch for the dispensing conduit revolution mechanism.

Revolution of the dispensing conduit 30 is prevented unless a coin has been deposited into the coin mechanism 20 by a clutch associated with the gear mechanism 60, best seen in FIG. 5. The gear mechanism 60 is mounted on a pin 64*a* so as to be axially moveable between a position remote from the dispensing conduit gear train 31 (comprising planetary gears 31 and 32) and a position engaged with the dispensing conduit gear train 31. A dispensing conduit drive gear 66 is mounted in a shaft portion 61*b* which slidably receives shaft portion 61*a* coupled to the dispensing conduit revolution knob 62. Thus, the shaft portion 61*b* supporting dispensing conduit drive gear 66 can thus move axially relative to the knob 62, allowing the drive mechanism 60 to move toward and away from dispensing conduit gear train 31, but the shaft portions 61*a* and 61*b* are rotationally fixed relative to one another.

Rotating the coin mechanism 20 by turning handle 20*a* actuates the clutch to bring the gear mechanism 60 into engagement with the dispensing conduit gear train 31, by rotating a cam 20*b* which forces a lever 64 to overcome the biasing force of tension spring 65*a* and cause the gear mechanism 60 to swing on its mounting pivot 64*a*, such that the dispensing conduit drive gear 66 engages the dispensing conduit gear train 31.

A latch 68, biased toward the mounting arm 65 by a spring 68*a*, snaps into an engaged position when the hook 68*b* clears the lower end of the mounting arm 65, latching the gear mechanism 60 into the engaged position. Although the gear mechanism 60 is biased toward the disengaged position by the tension spring 65*a* urging the mounting arm 65 in a direction away from the dispensing conduit gear train 31, the latch 68 retains the gear mechanism 60 in the engaging position as the dispensing conduit revolution knob 62 is rotated. This rotates the dispensing conduit drive gear 66 against gear 33, which in turn rotates gear 32 to cause the dispensing conduit 30 to revolve. The dispensing conduit 30 is rotationally coupled to the neck 40 by ribs 37 projecting from a bushing or sleeve 37*a*, best seen in FIG. 3A, so the neck 40 rotates as the dispensing conduit 30 rotates, which causes the head 70 to revolve in the product bin 12.

The cam 20*b* is oriented to force the gear mechanism 60 into the engaging position immediately after the coin has been accepted by the coin mechanism 20. For example, in a coin mechanism such as that described in U.S. Pat. No. 5,609,235, issued Mar. 11, 1997 to Schwarzli, which is incorporated herein by reference, a diameter measuring dog measures the coin during the rotational cycle of the mechanism and allows' the mechanism to rotate past the acceptance point only if a coin of the correct size has been deposited. This particular coin mechanism is referred to by way of example only, and it will be apparent to those skilled in the art that any coin mechanism capable of forcing the gear mechanism 60 into the engaging position is suitable for use in the vending machine 10 of the present invention, and the invention is not intended to be limited to any particular coin mechanism 20.

From the operator's standpoint, it is desirable to vend only a single article with each coin 1 deposited into coin mechanism 20. However, the user must be satisfied that the vending machine 10 will remain operable until an article 2 has been dispensed, otherwise users will not use the vending machine 10. In the preferred embodiment, the invention provides mechanism for releasing the clutch to disengage the dispensing conduit drive mechanism 60 only in response to an article 2 dropping through the dispensing conduit 30 into the dispensing chute 150.

In the preferred embodiment the clutch release mechanism comprises a flap 110 positioned beneath the dispensing conduit 30, biased to a position blocking the bottom of the dispensing conduit 30 and pivotable to an open position (shown in FIG. 2A) whereby the dispensing conduit 30 is in communication with the dispensing chute 150. A connecting rod 112 (shown in FIG. 5) pivots with the flap 110 and allows a spacer bar 114 hanging on a pivot 114*a* to move under the influence of gravity to a position between the latch 68 and a cam wheel 69 mounted on the shaft portion 61*b* so that it rotates with the shaft 61. The spacer bar 114 thus fills a space between the latch 68 and the cam wheel 69.

Figure 2B:
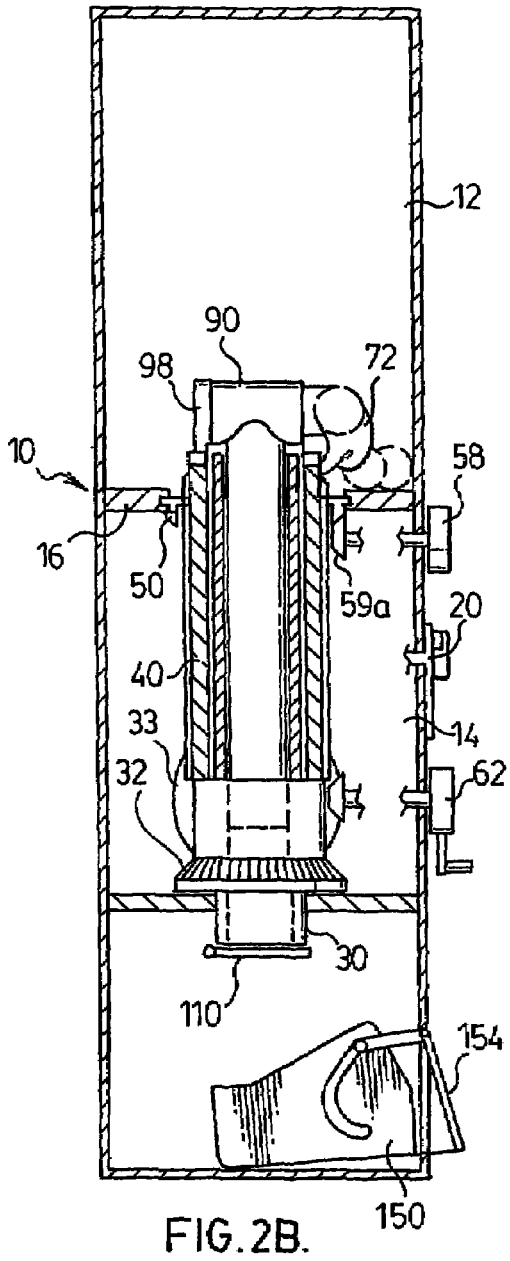
FIG. 2B is a cross-sectional side elevation of the bulk vender of FIG. 1 showing the product bin substantially empty.

When the flap 110 is in the closed position shown in FIG. 2B, the rod 112 holds the spacer bar 114 away from the space between the latch 68 and a cam wheel 69, and the cam 69*a* passes through the space without touching any other structure. However, when the flap 110 is opened by an article 2 falling through the dispensing conduit 30, the spacer bar 110 drops into the space and next time the cam 69*a* passes the latch 68 it pushes the spacer bar 114 against the latch 68 in the unlatching direction, which in turn pushes the latch 68 to unhook the latch 68 from the gear mechanism 60. The spring 65*a* then pulls the gear mechanism 60 out of engagement with the dispensing conduit gear train 31, releasing the clutch and disconnecting the knob 62 from the dispensing conduit gear train 31.

This prevents any further revolution of the mouth 80 in the product bin 12. In order to re-engage the gear mechanism 60 to the dispensing conduit gear train 31, a coin 1 must be deposited into the coin mechanism 20 and the coin mechanism 20 must be rotated until the cam 20*b* again engages the clutch by forcing the dispensing conduit gear mechanism 60 into engagement with the dispensing conduit gear train 31.

The dispensing chute 150 in the preferred embodiment comprises an open-ended trough pivotally mounted near the floor of the base compartment 18, as at 152. In the preferred embodiment means is provided for preventing a user from accessing the inside of the base compartment 18. The open end 150*a* of the dispensing chute 152 is accessed by manually opening access door 154, which is hinged to the vender body as at pivots 155 and articulated to side walls of the dispensing chute 152 via arms 156 fixed to the door 154. The arms 156 thus pivot with the door 154 as the door 154 is raised to the dispensing position. The free ends of the arms 154 are provided with bushings or rollers 158, which are trapped in grooves 160 formed in or through the side walls of the dispensing chute 152. The shape of the grooves 160 is such that as the door 154 is opened the rollers 158 riding along the grooves 160 raise the dispensing chute 152 from the rest position shown in FIG. 13A to the dispensing position shown in FIG. 13B.

Preferably the flap 110 overlaps the closed end 150*b* of the dispensing chute 152. This serves to ensure that the flap 110 and the dispensing chute 152 do not interfere with one another in operation; that the flap 110 closes properly when the user retrieves their purchase from the dispensing chute 152, to reset the clutch release mechanism for the next user; and that the user cannot access the dispensing conduit 30 while the access door 154 is open.

The invention thus operates as follows: A service person grasps the head 70 and manually raises the neck 40, either by grasping the neck 40 or by drawing the counterweight 130 toward the bottom of the base compartment 18 so that the cable 120 raises the neck 40. The service person fills the product bin 12 with articles 2, then lowers the head 70 onto the top of the heap of articles 2 and locks the vender 10 by engaging a lock (not shown) through the top 13 to the threaded post 123 on the top securing bracket 122.

A user deposits a coin 1 into the coin mechanism 20 and rotates the handle 20*a*. This rotates the cam 20*b*, which forces the gear mechanism mounting arm 65 to pivot toward the dispensing conduit 30, and thus forces the gear mechanism 60 (and particularly dispensing conduit drive gear 66) into engagement with the dispensing conduit gear train 31 comprising gears 32 and 33.

The user lowers the mouth 80 to the capturing position by rotating the neck rotation knob 58, which rotates the neck rotation gear 50 via shaft 59 to rotate the neck 40. As the neck 40 rotates the teeth 41 around the upper rim of the neck 40 engage the teeth around the periphery of the mouth rotation gear 98, to rotate the mouth 80 down to the capturing position shown in FIG. 9.

The user can then turn the dispensing conduit drive handle 62, causing the mouth 80 to revolve on the surface of the heap of articles 2 in the product bin 12. This forces the adapter 72 forward against the heap of articles 2 until an article 2 is captured by the adapter 72. The finger 92 prevents the article 2 from entering the exposed end 84 of the mouth 80, so the article is held in the adapter 72, as shown in FIG. 7. To dispense the article 2 the user rotates the neck rotation knob 58, which rotates the mouth rotation gear 98 through neck rotation gear 50 and neck 40 to raise the mouth 80. As the mouth 80 is rotated toward the dispensing position the finger 92 recedes from the exposed end 84 of the mouth 80. At the dispensing position, shown in FIG. 3A, the finger 92 has substantially receded from the exposed end 84 of the mouth 80, and the article 2 drops into the elbow 82.

As the user continues to turn the neck rotation knob 58, the opening 88 in the concealed end 86 of the mouth 80 comes into alignment with the upper end of the neck 40 and the article 2 drops through the neck, and then through the dispensing conduit 30.

As the article 2 drops through the bottom end of the dispensing conduit 30 it strikes the flap 110, forcing the flap 110 to the open position shown in FIGS. 2A and 13A. As the flap 110 opens, the connecting rod 112 recedes toward the dispensing conduit 30 and allows the bottom end of the spacer bar 114 to swing into the space between the latch 68 and the cam wheel 69. Further rotation of the dispensing conduit drive knob 62 turns the cam 69*a* against the spacer bar 114. The spacer bar 114 in turn pushes against the latch 68 and unlatches the latch 68 from the gear mechanism mounting arm 65. The spring 65*a*, which is in a tensioned condition whenever the gear mechanism 60 is engaged to the dispensing conduit gear train 31, forces the gear mechanism 60 to disengage from the dispensing conduit gear train 31, thus preventing further revolution of the dispensing conduit 30. This completes the dispensing cycle.

If the vending machine 10 is not completely reset after the dispensing cycle is complete, for example if the user simply removes the dispensed article 2 and does not further turn the dispensing conduit drive knob 62 to unlatch the latch 68 and release the clutch, the vending machine 10 will be completely reset when the next user tries to turn the dispensing conduit drive knob 62 unless the coin mechanism 20 is rotated to return the cam 20*b* back to the engaging position.

When the user opens the access door 154 to access the open end 150*a* of the dispensing chute 152 and retrieve their merchandise, the rollers 158 ride along the grooves 160 to raise the dispensing chute 152 to the dispensing position shown in FIG. 13B. This changes the attitude of the dispensing chute 150 so that the article 2 rolls down toward the open end 150*a*, and closes the flap 110. When the user releases the access door 154 the dispensing chute 150 returns to the rest position shown in FIG. 13A under the influence of gravity, but the flap 110 remains closed.

As articles 2 are dispensed from the product bin 12, the height of the heap of articles 2 diminishes. Because the neck 40 slides in telescopic relation to the dispensing conduit 30, the head 70 is always maintained on the top of the heap of articles 2 in a "floating" fashion by the cable 120. Optionally one or more agitators (not shown), may be provided to agitate the articles 2 as the neck 40 revolves and thus to maintain a substantially uniform product density throughout the product bin 12. As the articles 2 are depleted the neck 40 slides progressively lower over the dispensing conduit 30, until the product bin 12 is substantially empty as shown in FIG. 2B.

Because the neck 40 rotates with the dispensing conduit 30, it is possible to rotate the mouth 80 between the capturing and dispensing positions by simply locking the mouth rotation gear 50 against rotation, and as the dispensing conduit 30 continues to revolve the mouth 80 will automatically move. However, in the preferred embodiment a mouth rotation knob 50 is provided so that the mouth 80 can be rotated between the capturing and dispensing positions independently of the revolution of the dispensing conduit 30, thus giving the user an additional degree of control over the capture of an article 2.

It is also possible to provide a mouth resetting mechanism (not shown), which may be actuated by the opening of the flap 110 or revolution of the dispensing conduit 30, so that the mouth 80 automatically returns to the capturing position at the end of a dispensing cycle. However, this is optional and detailed instructions (pictorial or otherwise) can be provided to show the user how to move the mouth 80 to the capturing position in order to capture an article 2. Moreover many users, particularly young users, will prefer to have total control over the position of the capturing mechanism.

As a safety feature, in the preferred embodiment the gear 66 can move slightly axially along the shaft portion 61*b*, just enough to disengage from the gear 33 even when the clutch mechanism is engaged. Thus, if the revolving dispensing conduit 30 jams during use and the user tries to force the dispensing conduit drive knob 62 too hard, rather than damaging the mechanism the spring 61*c* will compress and the gear 66 will slip out of engagement with gear 33. Also, if the teeth of the gear 66 are not exactly aligned with the teeth of the gear 33 when the cam 20*b* forces the gear mechanism 60 into the engaging position, the spring 61*c* will compress until the user starts to rotate the dispensing conduit drive handle 62, at which time the gear 66 will slip into engagement with the gear 33.

Various embodiments of the present invention having been thus described in detail by way of example, it will be apparent to those skilled in the art that variations and modifications may be made without departing from the invention. The invention includes all such variations and modifications as fall within the scope of the appended claims.

I claim:

1. A vending machine, comprising a product bin for storing articles, disposed above a secure compartment, a dispensing chute in communication with a neck, the dispensing chute being accessible to a user and the neck being movable substantially vertically within the product bin, a mouth movable between a capturing position and a dispensing position, to be respectively in communication with articles the product bin and with the neck, the mouth being capable of revolving about an axis of the neck, and an actuator for actuating a mechanism to revolve the mouth about the axis of the neck, whereby when the mouth is in the capturing position, revolution of the mouth captures an article from the top of the articles, and when the mouth is rotated to the dispensing position the article is dispensed through the neck and the dispensing conduit.

2. The vending machine of claim 1 wherein the dispensing chute is in communication with the neck through a dispensing conduit.

3. The vending machine of claim 2 wherein the neck is engaged to the dispensing conduit in telescoping relation.

4. The vending machine of claim 3 wherein the neck is supported in the product bin to reduce its effective weight.

5. The vending machine of claim 4 wherein the neck is suspended from a cable.

6. The vending machine of claim 5 wherein the cable is affixed to at least one counterweight.

7. The vending machine of claim 2 wherein the dispensing chute has an open end in communication with an access door, the door having at least one arm affixed to the dispensing chute such that as the door is opened the dispensing chute is raised from a rest position to a dispensing position.

8. The vending machine of claim 7 wherein the dispensing conduit is provided with a flap movable between open and closed positions, the flap overlapping a closed end of the dispensing chute, whereby when the door is opened and the dispensing chute is raised to the dispensing position the flap closes.

9. The vending machine of claim 8 wherein an article falling through the dispensing conduit and opening the flap releases a clutch to disengage the actuator from the mechanism and prevent the user from revolving the mouth.

10. The vending machine of claim 1 comprising a finger mounted so as to block the mouth in the capturing position and allow an article to pass into the mouth in a dispensing position.

11. The vending machine of claim 1 wherein the actuator is enabled when coin or token is deposited into a coin mechanism.

12. The vending machine of claim 1 wherein separate actuators are provided for enabling the revolving mechanism and for moving the mouth to the dispensing position.

13. A method of vending an article in a bulk vender comprising a product bin for storing articles disposed above a secure compartment, a mouth in communication with a neck in communication with a dispensing chute accessible to a user, the mouth being movable substantially vertically within the product bin and rotatable between a capturing position in which the mouth is communication with articles the product bin and a dispensing position in which the mouth is in communication with the neck but not the articles in the product bin, comprising the steps of:

a. moving the mouth to the capturing position;

b. enabling a revolving mechanism and revolving the mouth about the product bin to capture at least one article;

c. moving the mouth to the dispensing position, such that the captured article is dispensed through the neck into the dispensing chute; and d. preventing further revolution of the mouth after the captured article has been dispensed until the revolving mechanism is enabled.

14. The method of claim 13 including in step a the substep of interrupting communication between the neck and the mouth when the mouth is moved to the capturing position.

15. The method of claim 13 wherein the revolving mechanism is enabled by inserting a coin or token into a coin mechanism.

16. The method of claim 15 including the step of supporting the neck in the product bin to reduce its effective weight.

17. The method of claim 13 wherein separate actuators are provided for enabling the revolving mechanism and for moving the mouth to the dispensing position.

18. The method of claim 13 wherein the dispensing chute has an open end in communication with an access door, including the step of raising the dispensing chute from a rest position to a dispensing position when the door is opened.

19. The method of claim 18 wherein the a flap movable between open and closed positions is provided to interrupt communication between the neck and the dispensing chute, including the step of closing the flap when the dispensing chute is raised to the dispensing position.

20. The method of claim 13 including the step of blocking an opening to the neck in the capturing position so that an article can be captured by the mouth but not conveyed to the neck for dispensing until the mouth is rotated to the dispensing position.

* * * * *